United States Patent [19]

Brands et al.

[11] Patent Number: 4,635,550

[45] Date of Patent: Jan. 13, 1987

[54] GAP FILLER BLANKET FOR PRINTING CYLINDER

[75] Inventors: George B. Brands, Wilmette, Ill.; James R. Carlson, Racine, Wis.

[73] Assignee: American Roller Company, Bannockburn, Ill.

[21] Appl. No.: 710,060

[22] Filed: Mar. 11, 1985

[51] Int. Cl.[4] ..... B41F 27/06; B41F 27/12

[52] U.S. Cl. ..... 101/415.1

[58] Field of Search ..... 101/217, 415.1; 428/909

[56] References Cited

U.S. PATENT DOCUMENTS

| | | | |
|---|---|---|---|
| 1,211,706 | 1/1917 | Hoerbelt | 428/909 |
| 1,471,895 | 10/1923 | Huebner | 101/217 |
| 1,668,258 | 5/1928 | Adsit | 101/217 |
| 2,055,295 | 9/1936 | Kessler | 101/415.1 |
| 2,664,821 | 1/1954 | Hattman | 101/415.1 |
| 2,986,085 | 5/1961 | Johnson | 101/177 |
| 3,025,792 | 3/1962 | Abiuso | 101/217 |
| 3,049,996 | 8/1962 | Downie | 101/217 |
| 3,164,089 | 1/1965 | Browning | 101/426 |
| 3,261,289 | 7/1966 | Cash et al. | 101/426 |
| 3,453,955 | 7/1969 | Seel et al. | 101/216 |
| 3,453,956 | 7/1969 | Ellis et al. | 101/217 |
| 3,765,329 | 10/1973 | Kirkpatrick et al. | 101/415.1 |
| 4,341,157 | 7/1982 | Simeth | 101/375 |

FOREIGN PATENT DOCUMENTS

| | | | |
|---|---|---|---|
| 186648 | 8/1956 | Austria | 101/415.1 |
| 431259 | 7/1926 | Fed. Rep. of Germany | 101/415.1 |
| 1367860 | of 1963 | France | 101/415.1 |
| 1494854 | 7/1966 | France | 101/415.1 |
| 363464 | 12/1931 | United Kingdom | 101/415.1 |
| 666356 | 2/1952 | United Kingdom | 101/415.1 |

*Primary Examiner*—Edgar S. Burr
*Assistant Examiner*—Tonya Eckstine
*Attorney, Agent, or Firm*—Quarles & Brady

[57] ABSTRACT

A blanket for a printing cylinder of the type having a core with a lateral gap along the periphery of the core is disclosed. The blanket includes a non-extensible backing which is suitable to be wrapped around the core and has first and second opposed lateral ends suitable to be attached to the core within the gap. A filler portion extends laterally across and is fixed to the first lateral end and an elastomeric covering is secured over the backing and filler portion. The filler portion spans the gap beneath the covering between the first and second lateral ends of the backing to support the covering over the gap. Supporting the covering over the gap provides the printing cylinder with a substantially continuous circumference to reduce shocks and vibrations throughout the printing press.

3 Claims, 2 Drawing Figures

GAP FILLER BLANKET FOR PRINTING CYLINDER

BACKGROUND OF THE INVENTION

This invention relates to cylinders for printing presses and in particular to blankets for printing cylinders.

Offset lithographic printing presses have a plate cylinder, a blanket cylinder and an impression cylinder. The cylinders are arranged with their axes parallel and with the periphery of the blanket cylinder contacting the peripheries of both the plate and impression cylinders. Ink is applied to a printing plate carried on the plate cylinder. The image is transferred from the plate to a relatively soft and yieldable elastomeric blanket of the blanket cylinder each time the plate passes the blanket cylinder. A web to be printed is passed into the nip formed by the blanket and impression cylinders to transfer the image from the blanket cylinder to the web.

The blanket cylinder usually has a leteral gap along its periphery in which the ends of the blanket are attached to a core of the cylinder. As the leading and trailing edges of the gap pass an adjacent cylinder, pressure between the blanket cylinder and the adjacent cylinder is relieved and established, respectively. The continuous relieving and establishing of pressure by the gap as the cylinders are rotated against one another causes vibration and shockloads in the cylinders and throughout the press which affect print quality. For example, at the time that the gap of the blanket cylinder relieves and establishes pressure with the plate cylinder, printing may be taking place in the nip between the blanket cylinder and the impression cylinder. Any movement of the blanket cylinder caused by the relieving and establishing of pressure at that moment can affect the image which is transferred from the blanket cylinder to the web. Also, when the gap of the offset cylinder passes the impression cylinder, any image being transferred from the plate cylinder to the blanket cylinder may be affected. The result of these vibrations and shockloads has been to limit the speed at which printing presses can be run with acceptable print quality.

SUMMARY OF THE INVENTION

The invention provides a blanket to be wrapped around a core having a lateral gap along the periphery of the core to provide a printing cylinder with a substantially continuous circumference. The blanket includes a non-extensible backing which is suitable to be wrapped around the core and has first and second opposed lateral ends suitable to be attached to the core within the gap. A filler portion extends laterally across and is fixed to the first lateral end and an elastomeric covering is secured over the backing and filler portion. The filler portion spans the gap between the first and second lateral ends of the backing beneath the covering to support the covering over the gap and thereby provide a substantially continuous circumference of the printing cylinder.

Since the circumference of a printing cylinder including a blanket of the invention is substantially continuous, there is no gap to alternately relieve and establish pressure between the printing cylinder and adjacent cylinders. This greatly reduces or eliminates the shocks and vibrations attributable to such gaps in prior art cylinders. Therefore, a printing press including a printing cylinder having a blanket of the invention can be operated at higher speeds than possible with prior art cylinders and still yield acceptable print quality.

In the preferred embodiment, the blanket has a pair of opposed lateral edges. One of the edges is positioned adjacent to the second end of the backing and the other edge is positioned adjacent to the filler portion so that the edges are closely spaced when the blanket is wrapped around the core. By positioning the edges of the covering adjacent to the separable interface between the second lateral end and the filler portion, the blanket can be wrapped or unwrapped to or from the core to facilitate replacement of the blanket.

In another aspect, the edges of the covering are cut at an angle and overlap. The angle of the edges extends radially outwardly away from the direction of intended rotation of the cylinder. This helps counteract the tendency of the adjacent cylinders to peel the edges of the covering from the backing as the edges rotate past the adjacent cylinders.

In another aspect, the filler portion is made of an elastomeric material. The elastomeric material is sufficently hard and strong to support the covering against the pressure exerted upon it by adjacent cylinders. However, the elastomeric material can also yield somewhat as it is drawn down into the gap to allow for dimensional tolerances of the core and backing.

These and other aspects and advantages of the invention will become apparent from the following detailed description and from the drawings.

DETAILED DESCRIPTION OF THE PREFERRED EMBODIMENT

Figure 1:
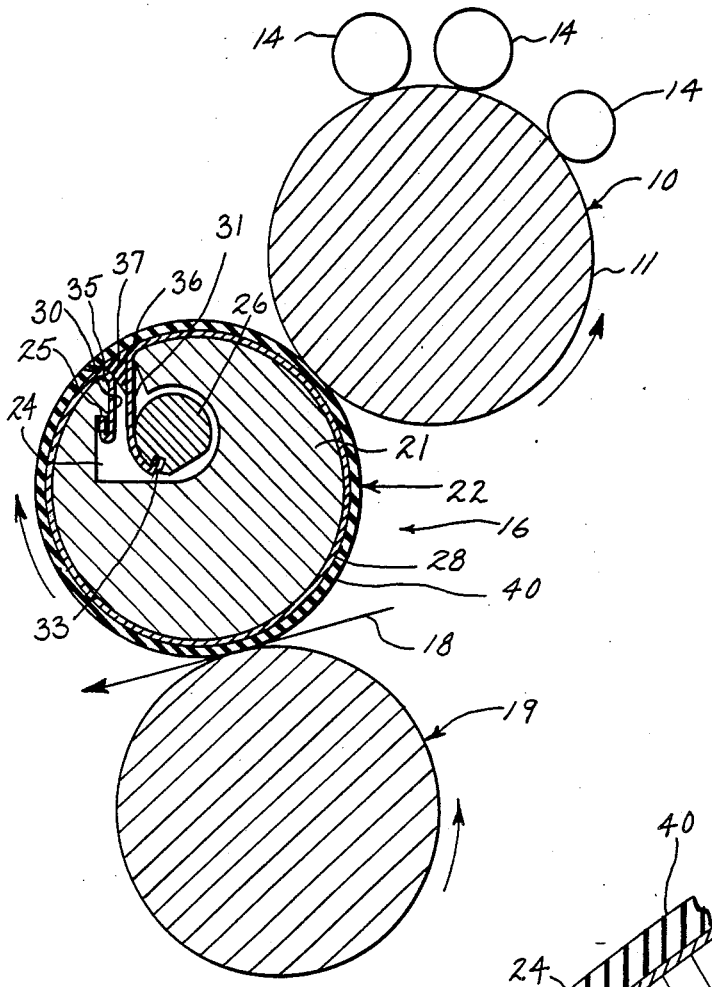
FIG. 1 is a cross-sectional view showing an arrangement of printing cylinders to provide an offset printing process which include a blanket cylinder having a blanket of the invention.

FIG. 1 shows an arrangement of printing cylinders to provide an offset process. The printing cylinders can be of any suitable length and are journaled on their ends for rotation in the directions indicated. Hereinafter, the lateral direction is defined as the direction parallel to the axes of the cylinders and the radial direction is perpendicular to the axes of the cylinders. Also, references to the length of a cylinder are meant to be to the working length of the cylinder, that is, the length of the cylinder which contacts the adjacent cylinders. The "length" of a cylinder therefore does not include the ends of the cylinder which are required to rotatably mount the cylinder.

The printing cylinders include a plate cylinder 10 which carries a printing plate 11 on its periphery. Ink is applied to the plate 11 by suitable ink distribution roller 14. The image is transferred from the plate cylinder 10 to a blanket cylinder 16 each time the plate 11 rotates past the blanket cylinder 16. A web 18 to be printed, such as a sheet of paper, is passed into a nip formed by the blanket cylinder 16 and an impression cylinder 19 to transfer the image from the blanket cylinder to the web 18.

A certain pressure exists along the lines of contact between the blanket cylinder 16 and the plate cylinder 10 and between the blanket cylinder 16 and the impression cylinder 19. The pressure between the blanket cylinder 16 and the plate cylinder 10 is necessary to insure that the image is properly transferred from the plate 11 to the blanket cylinder 16. The pressure between the blanket and impression cylinders insures a good transfer of the image from the blanket cylinder 16 to the web 18 and that there will be adequate frictional contact to draw the web 18 through the nip.

The blanket cylinder 16 includes a conventional core 21 and a blanket 22 of the invention which covers the core. The core 21 has a lateral gap 24 along its periphery which runs for the length of the cylinder. The gap 24 has a mouth adjacent to the outer periphery of the core 21 which opens into an inner portion of the gap in which means for attaching the blanket 22 to the core 21 are disposed. These attaching means include a lip 25 and a tensioning bar 26 which extend for the length of the gap 24. The tensioning bar 26 is rotatable in the counter-clockwise direction as viewed in FIG. 1 to allow tightening of the blanket 22 around the core 21. A suitable ratchet means (not shown) can be provided to enable one-way rotation of the tensioning bar 26 to prevent the blanket 22 from loosening around the core 21.

The blanket 22 includes an inner layer of a non-extensible backing 28 which is about as wide laterally as the cylinder is long. A backing 28 made of a sheet of stainless steel of about 0.007 inches thickness was found to have the requisite strength and flexibility properties in practice. The backing 28 has opposed lateral ends 30 and 31 which are bent inwardly to enter the gap 24 and are formed to be secured to the core 21 by the lip 25 and tensioning bar 26. The end 30 is formed so that its lateral edge catches on the lip 25 and the backing 28 emerges from the mouth of the gap 24 in a trailing edge 35. The trailing edge 35 has a radius and forms an acute angle to follow the form of the core 21 out of the mouth of the gap 24. The backing 28 is then wrapped around the core 21 to a leading edge 36 where it reenters the gap 24. The end 31 extends inwardly from the leading edge 36, traversing the mouth of the gap 24, and the end 31 is formed to be received within a slot 33 of the tensioning bar 26. As mentioned above, the tensioning bar 26 can be turned in the counter-clockwise direction as viewed in FIG. 1 to tighten the backing 28 around the core 21.

Figure 2:
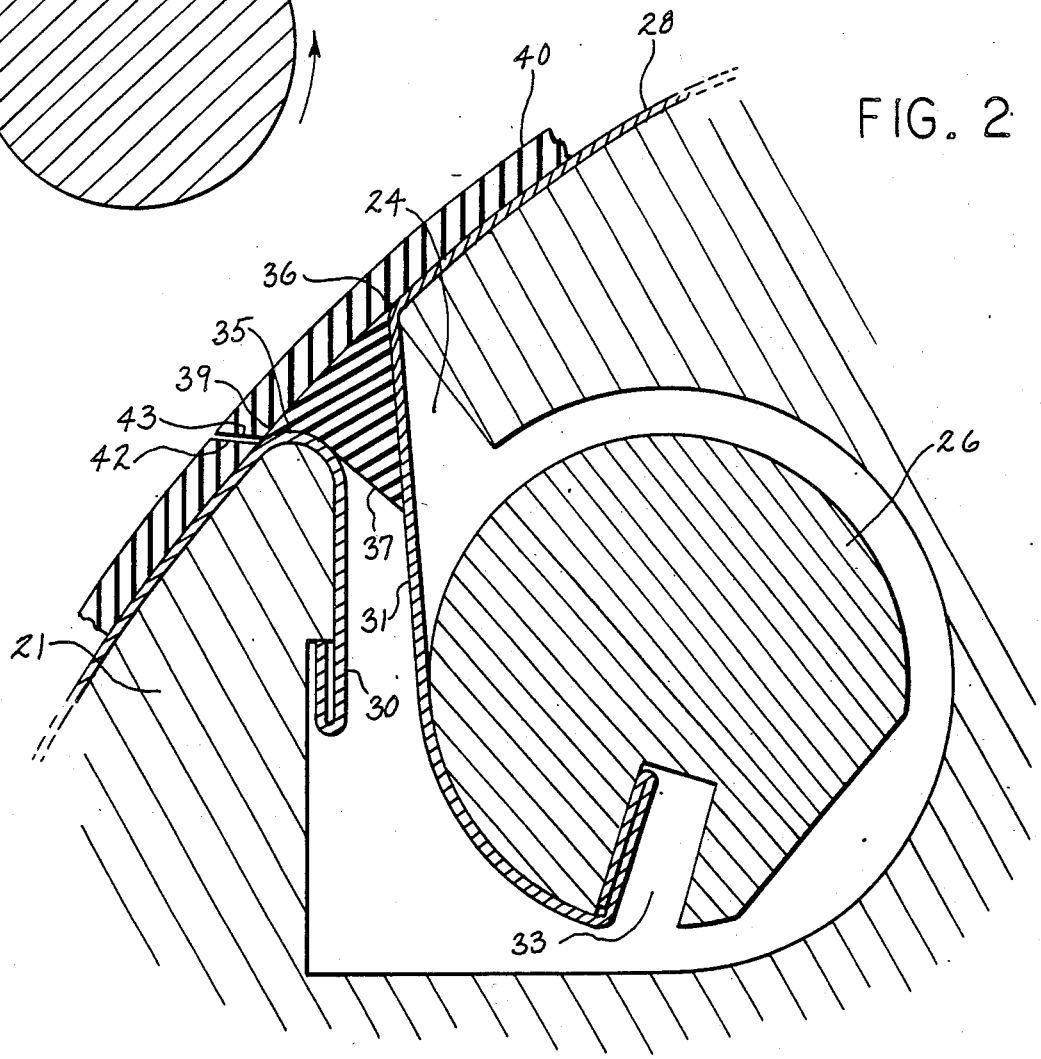
FIG. 2 is a detail view of a portion of the blanket cylinder illustrated in FIG. 1.

A lateral filler portion 37 spans the mouth of the gap 24 between the leading edge 36 of the end 31 and the trailing edge 35 of the end 30. The filler portion 37 extends for the length of the gap 24 and is made of a relatively hard elastomer. An elastomer having a hardness of approximately 90 durometer, Shore A, was found suitable in practice. As best shown in FIG. 2, the radially outer surface of the filler portion 37 is of about the same radius as the radially outer surface of the backing 28. Also, the filler portion 37 is formed to conform to the leading and trailing edges 36 and 35, respectively, to provide a smooth transition between the radially outer surfaces of the backing 28 and filler portion 37.

The filler portion 37 is fixed to the end 31 of the backing 28 adjacent to and radially inward from the leading edge 36. The filler portion 37 spans the gap 24 from the leading edge 36 to a free edge 39 which is adjacent to the trailing edge 35. One way of fixing the filler portion 37 to the backing 28 is by chemical bonding, such as by applying a bonding agent between the backing 28 and the filler portion 37 and then vulcanizing the assembly of the core 21, the backing 28 and the filler portion 37. Regardless of how the filler portion 37 is fixed to the lateral end 31, the lateral end 31 supports the filler portion 37 in the mouth of the gap 24 with the radially outer surfaces of the backing 28 and filler portion 37 defining a substantially continuous circular cylindrical circumference when the backing 28 is tight around the core 21. Note that the filler portion 37 is fixed to only one of the ends of the backing 28 so that the backing 28 can be removed from the core by simply releasing its ends from the lip 25 and tensioning bar 26 and unwrapping it from the core 21.

The final processing step in fabricating a blanket 22 is to secure an outer layer over the backing 28 and filler portion 37. The outer layer is a relatively soft elastomeric covering 40 which yields slightly under the pressures between the blanket cylinder and the plate and impression cylinders. Since the covering 40 is elastically yieldable, it helps to maintain a uniform pressure across the length of the cylinders to insure and even transfer of the image between the plate and blanket cylinders and to the web.

The covering 40 can be chemically bonded to the backing 28 and to the filler portion 37 by applying a bonding agent between the covering 40 and the backing 28 and filler portion 37 and vulcanizing the entire assembly. The bonding process is preferably carried out with the backing 28 and filler portion 37 assembled to the core 21 to insure dimensional accuracy. Of course, if blankets are to be mass-produced, it may be pratical to use a suitable fixture in lieu of the core 21 to carry out the bonding of the filler portion 37 and the covering 40 to the backing 28 and to each other. After the covering 40 is secured to the backing 28 and filler portion 37, the covering 40 can be ground to the desired roundness, diameter and/or thickness.

The covering 40 is secured to the backing 28 and filler portion 37 with its lateral edges 42 and 43 closely spaced and positioned so that the blanket 22 can be removed from the core 21. The edge 42 is positioned adjacent to the trailing edge 35 of the backing 28 and the edge 43 is positioned adjacent to the free edge 39 of the filler portion 37. Although the free edge 39 overlaps the trailing edge 35 to provide a continuous circumferential surface therewith, the filler portion 37 is not bonded to the end 30 so that the free edge 39 can be separated from the trailing edge 35. Positioning the edges 42 and 43 adjacent to the separable interface between the filler portion 37 and the end 30 of the backing 28 therefore enables the blanket 22 to be unwrapped from the core 21 to facilitate removal and replacement of the blanket 22.

The ends 42 and 43 preferably overlap and angle radially outwardly away from the direction of rotation of the blanket cylinder 16. This arrangement helps counteract the tendency of the adjacent cylinders and of the web 18 to peel the ends 42 and 43 off of the blanket cylinder 16.

In prior art blanket cylinders, the blanket usually consisted essentially of an elastomeric covering which was backed with a material such as cloth. The lateral ends of the blanket were secured in the gap of the core which resulted in a lateral gap along the periphery of the cylinder where the blanket entered the gap. Each time the leading and trailing edges of this gap passed the plate or impression cylinders, the pressure normally existing between the blanket cylinder and the plate or impression cylinder was alternately relieved and established. This alternate relief and establishment of pressure between the cylinders caused undesirable vibration and shockloads which affected print quality and limited the speed at which the press could be run.

A blanket of the invention reduces shocks and vibrations in printing presses by eliminating the lateral gap which existed along the periphery of prior art blanket cylinders. The filler portion 37 spans the gap 24 beneath the covering 40 and between the ends 30 and 31 of the backing 28 to support the covering 40 over the gap. Only a relatively small space exists between the ends 42 and 43 of the covering 40. This small space does not allow the large variation in pressure which existed due to the gaps in prior art blanket cylinders and therefore greatly reduces the shocks and vibrations attributable to those gaps.

Ideally, the filler portion 37 would be made of an incompressible material such as metal to give the most support possible to the covering 40 over the gap 24. However, due to dimensional tolerances of the core 21 and of the backing 28, the filler portion 37 is preferably somewhat deformable. Therefore, as the backing 28 is tightened around the core 21 by the tensioning bar 26 and the filler portion 37 is pulled down into the mouth of the gap 24, the filler portion can conform around and between the trailing and leading edges 36 and 35, respectively, to substantially fill the mouth of the gap beneath the covering 40.

As mentioned above, the backing 28 is non-extensible so that it is very resistant to stretching. The backing 29 must be non-extensible to support the filler portion 37 against the pressure exerted upon it as it rotates by the plate or impression cylinders. The backing 28 must also be flexible enough to be wrapped around the core 21 and tightened therearound by the tensioning bar 26. Many materials in addition to the stainless steel sheet material which was used in practice are both non-extensible and relatively flexible. Therefore, it is considered that many different materials could be used to make the backing 28 with good results.

Numerous modifications and variations to the preferred embodiment will be apparent to those skilled in the art but which will still embody the invention. For example, it may be possible to integrally mold the covering 40, the filler portion 37 and the backing 28. Therefore, the invention is not intended to be limited by the scope of the preferred embodiment, but only by the claims which follow.

We claim:

1. In a printing cylinder including a core and a blanket, the core having a gap extending laterally along its periphery, means for securing one end of the blanket stationary and a rotatable tensioning bar for attachment to the other end of the blanket to tighten the blanket around the core disposed in the gap, the blanket having an outer layer of elastomeric covering and an inner layer of backing fixed to the covering, the improvement wherein:

the backing is non-extensible and has a first lateral end for attachment to the tensioning bar and a second lateral end for attachment to the second means:

the covering extending over and past the gap, said covering having a pair of opposed lateral edges which angle radially outwardly away from the direction of rotation of the cylinder and overlap; and a yieldable elastomeric filler portion fixed to the first lateral end and to the portion of the covering which extends over the gap, said filler portion abutting the second lateral end and yielding to fill the gap beneath the covering between the first and second lateral ends as the tensioning bar is rotated to tighten the backing and support the covering over the gap so that the printing cylinder has a substantially continuous circular circumference.

2. A blanket as in claim 1 wherein:

the filler portion extends from the first lateral end to a free edge away from the first lateral end; and One at the edges of the covering is secured to the second lateral end of the backing and the other of said edges is secured to the free edge of the filler portion; and wherein the edges of the covering are no further than the thickness of the covering away from one another when the blanket is attached around the core.

3. A blanket as in claim 1, wherein the filler portion and the covering are chemically bonded to the backing and to one another.

* * * * *

UNITED STATES PATENT AND TRADEMARK OFFICE

CERTIFICATE OF CORRECTION

PATENT NO. : 4,635,550

DATED : January 13, 1987

INVENTOR(S) : George B. Brands and James R. Carlson

It is certified that error appears in the above-identified patent and that said Letters Patent is hereby corrected as shown below:

In claim 1, lines 15-16, change "the second means" to -- the securing means --.

In claim 2, line 34, change "One at the edges" to -- one of the edges --.

In column 1, line 20, change "leteral" to -- lateral --.

In column 2, line 43, change "offset process" to -- offset printing process --.

Signed and Sealed this

Twenty-eighth Day of April, 1987

*Attest:*

DONALD J. QUIGG

*Attesting Officer*

*Commissioner of Patents and Trademarks*